US008602919B2

(12) United States Patent
Bishop

(10) Patent No.: US 8,602,919 B2
(45) Date of Patent: Dec. 10, 2013

(54) PITCHING CAGE

(76) Inventor: Michael J. Bishop, West Carrollton, OH (US)

( * ) Notice: Subject to any disclaimer, the term of this patent is extended or adjusted under 35 U.S.C. 154(b) by 210 days.

(21) Appl. No.: 13/220,755

(22) Filed: Aug. 30, 2011

(65) Prior Publication Data

US 2012/0052989 A1 Mar. 1, 2012

Related U.S. Application Data

(60) Provisional application No. 61/379,006, filed on Sep. 1, 2010.

(51) Int. Cl.
*A63B 67/00* (2006.01)
*A63B 69/00* (2006.01)

(52) U.S. Cl.
USPC ..... 473/421; 473/454; 473/456; 473/422

(58) Field of Classification Search
USPC ..... 473/422, 421, 446, 454, 476, 434, 435, 473/438, 451, 456, 455, 477; 273/348, 273/400–402, 410
See application file for complete search history.

(56) References Cited

U.S. PATENT DOCUMENTS

| | | | |
|---|---|---|---|
| 2,021,989 | A | 11/1935 | De Master |
| 3,312,467 | A | 4/1967 | Dawson |
| 3,583,703 | A | 6/1971 | Brown |
| 3,706,451 | A | 12/1972 | Dixon |
| 3,997,158 | A | 12/1976 | Britton |
| 4,118,028 | A | 10/1978 | Larkin |
| 4,210,326 | A | 7/1980 | Booth et al. |
| 4,254,952 | A | 3/1981 | Playter, Jr. |
| 4,275,883 | A | 6/1981 | Grimaldi et al. |
| 4,295,648 | A | 10/1981 | Stromback |
| 4,333,646 | A | 6/1982 | Pfeilsticker |
| 4,415,154 | A | 11/1983 | Engelhardt |
| 4,473,227 | A | 9/1984 | Klaus |
| 4,497,485 | A | 2/1985 | Macosko |
| 4,563,005 | A | 1/1986 | Hand et al. |
| 4,629,188 | A | 12/1986 | Mahieu |
| 4,643,423 | A | 2/1987 | Wright |
| 4,657,250 | A | 4/1987 | Newland et al. |
| 4,768,784 | A | 9/1988 | Wilson |
| 4,781,376 | A | 11/1988 | Barnes, Sr. |

(Continued)

OTHER PUBLICATIONS

Pitching Essentials LLC, "Zone-In Pitching Target", http://www.pitchingessentials.com/pe_bp/zonein/, May 27, 2007 (date located through http://web.archive.org/web/20070621092924/http://www.pitchingessentials.com/features.htm).

*Primary Examiner* — Mitra Aryanpour
(74) *Attorney, Agent, or Firm* — Thomas E. Lees, LLC

(57) ABSTRACT

A training cage for throwing practice, comprises a frame having a height, width and depth. The training cage also comprises a strike zone indicator that defines the boundaries of a strike zone and a pitch locator. The pitch locator is configured such that when the pitch locator is in cooperation with the strike zone indicator, the strike zone is defined by at least one strike area pass through that defines an area that allows a ball thrown within the strike zone to pass through the strike zone indicator and at least one strike area barricade that defines an area that obstructs the ball thrown within the strike zone from passing through the strike zone indicator. Moreover, the pitching cage comprises a target having a target surface that is suspended in a second designated position located behind the strike zone indicator.

14 Claims, 6 Drawing Sheets

(56) References Cited

U.S. PATENT DOCUMENTS

| | | | | | |
|---|---|---|---|---|---|
| 4,826,164 | A | | 5/1989 | Butcher | |
| 4,830,369 | A | | 5/1989 | Poitras | |
| 4,863,166 | A | | 9/1989 | Becera et al. | |
| 4,872,674 | A | | 10/1989 | Deal | |
| 4,883,272 | A | | 11/1989 | Lay | |
| 4,905,996 | A | | 3/1990 | Tallent et al. | |
| 4,913,427 | A | | 4/1990 | Wilson | |
| 4,930,774 | A | | 6/1990 | Butcher | |
| 4,955,607 | A | | 9/1990 | Maye | |
| D311,031 | S | | 10/1990 | Poitras | |
| 4,978,121 | A | | 12/1990 | Larkey | |
| 5,000,449 | A | | 3/1991 | Weeks | |
| 5,000,461 | A | * | 3/1991 | Borazjani | 473/476 |
| 5,046,729 | A | | 9/1991 | Yancey | |
| 5,064,194 | A | | 11/1991 | Bixler et al. | |
| D322,288 | S | | 12/1991 | Coleman | |
| 5,083,774 | A | | 1/1992 | Yalvac | |
| 5,133,548 | A | | 7/1992 | Bedord et al. | |
| D331,426 | S | | 12/1992 | Riffle et al. | |
| D333,856 | S | | 3/1993 | Cantey | |
| 5,222,731 | A | * | 6/1993 | Hanabusa et al. | 473/436 |
| 5,271,616 | A | | 12/1993 | Grimaldi | |
| 5,333,855 | A | * | 8/1994 | Silin et al. | 473/455 |
| 5,333,856 | A | | 8/1994 | Gery | |
| D350,569 | S | | 9/1994 | Boteler | |
| 5,348,291 | A | | 9/1994 | Scully | |
| 5,359,986 | A | | 11/1994 | Magrath, III et al. | |
| 5,368,293 | A | | 11/1994 | Waugh | |
| 5,419,549 | A | | 5/1995 | Galloway et al. | |
| 5,433,434 | A | * | 7/1995 | Helmetsie | 473/446 |
| 5,439,211 | A | | 8/1995 | Drabowsky | |
| D367,091 | S | | 2/1996 | Purdy | |
| 5,511,775 | A | * | 4/1996 | Parks | 473/454 |
| 5,524,901 | A | | 6/1996 | Bison et al. | |
| 5,553,846 | A | | 9/1996 | Frye et al. | |
| 5,553,847 | A | | 9/1996 | Surrency | |
| 5,573,240 | A | | 11/1996 | Humboldt | |
| D376,396 | S | | 12/1996 | Nelson | |
| 5,588,645 | A | | 12/1996 | Schwan et al. | |
| 5,599,017 | A | | 2/1997 | Bixler et al. | |
| 5,611,531 | A | | 3/1997 | Skerlan | |
| D380,797 | S | | 7/1997 | Schwan et al. | |
| 5,672,125 | A | | 9/1997 | Ross | |
| 5,704,855 | A | | 1/1998 | Kellogg, Jr. | |
| 5,746,671 | A | | 5/1998 | Ritchie | |
| 5,803,841 | A | | 9/1998 | Daskoski | |
| 5,803,842 | A | | 9/1998 | Ross | |
| 5,984,810 | A | | 11/1999 | Frye et al. | |
| 6,093,120 | A | | 7/2000 | Luke, Jr. | |
| 6,155,936 | A | | 12/2000 | Dorr | |
| 6,322,461 | B1 | | 11/2001 | Walsh | |
| 6,350,211 | B1 | | 2/2002 | Kolmar | |
| 6,402,641 | B1 | | 6/2002 | Lee | |
| D479,295 | S | | 9/2003 | Vesledahl | |
| 6,620,065 | B2 | | 9/2003 | Clabough | |
| 6,651,497 | B2 | | 11/2003 | Imatoh | |
| 6,663,513 | B2 | | 12/2003 | Howard | |
| 6,695,724 | B2 | * | 2/2004 | Birss | 473/446 |
| 6,837,809 | B2 | | 1/2005 | Majumdar | |
| 6,878,078 | B2 | | 4/2005 | Swanson | |
| D509,872 | S | | 9/2005 | Alberti | |
| 6,945,883 | B1 | | 9/2005 | Williams et al. | |
| 6,955,615 | B1 | | 10/2005 | Cavell | |
| 7,150,689 | B2 | | 12/2006 | Balingit | |
| 7,153,225 | B2 | | 12/2006 | Morrow | |
| 7,175,550 | B1 | | 2/2007 | Bellah, Jr. et al. | |
| 7,179,179 | B2 | | 2/2007 | McDaniel | |
| 7,217,202 | B2 | | 5/2007 | Troxell | |
| 7,220,194 | B1 | | 5/2007 | Laiacona, Jr. et al. | |
| 7,255,658 | B1 | | 8/2007 | VanKuiken et al. | |
| 7,393,291 | B2 | | 7/2008 | Huang et al. | |
| 7,399,241 | B1 | | 7/2008 | Thomas, Sr. | |
| 7,415,976 | B1 | | 8/2008 | Powell | |
| 7,435,194 | B1 | | 10/2008 | Lewis | |
| 7,445,569 | B2 | | 11/2008 | Comello, Jr. | |
| 7,462,115 | B2 | | 12/2008 | Morrow | |
| 7,470,202 | B1 | | 12/2008 | Lewis | |
| 7,479,075 | B2 | | 1/2009 | Burruss, Jr. | |
| 7,517,290 | B1 | | 4/2009 | Springer | |
| 7,563,183 | B2 | | 7/2009 | Kucek | |
| 7,601,081 | B1 | | 10/2009 | Larkey | |
| 7,614,967 | B1 | | 11/2009 | Lewis | |
| 7,621,830 | B1 | | 11/2009 | Kucek | |
| 7,651,417 | B1 | | 1/2010 | Sims | |
| 7,762,912 | B2 | | 7/2010 | Lewis | |
| 7,811,184 | B2 | * | 10/2010 | Siefker | 473/446 |
| 8,001,838 | B2 | * | 8/2011 | Roberts | 473/455 |
| D680,600 | S | * | 4/2013 | Piot | D21/699 |
| 2002/0020217 | A1 | | 2/2002 | Imatoh | |
| 2002/0049103 | A1 | | 4/2002 | Treihart | |
| 2002/0081002 | A1 | | 6/2002 | Lee et al. | |
| 2002/0091021 | A1 | | 7/2002 | Clabough | |
| 2003/0027671 | A1 | | 2/2003 | Kuhn et al. | |
| 2003/0078117 | A1 | | 4/2003 | Howard | |
| 2003/0132574 | A1 | | 7/2003 | McDonald et al. | |
| 2003/0139232 | A1 | | 7/2003 | Martin | |
| 2003/0228943 | A1 | | 12/2003 | Powell | |
| 2004/0005942 | A1 | | 1/2004 | Wang | |
| 2004/0033849 | A1 | | 2/2004 | Socci | |
| 2004/0033850 | A1 | | 2/2004 | Socci | |
| 2004/0053711 | A1 | | 3/2004 | Conradi | |
| 2004/0127308 | A1 | | 7/2004 | Swanson | |
| 2004/0162166 | A1 | | 8/2004 | Tien | |
| 2004/0178585 | A1 | | 9/2004 | Cosenza | |
| 2004/0180736 | A1 | | 9/2004 | Majumdar | |
| 2005/0288129 | A1 | | 12/2005 | Lewis | |
| 2006/0019775 | A1 | | 1/2006 | Nurthen | |
| 2006/0068947 | A1 | | 3/2006 | Kempf | |
| 2006/0199673 | A1 | | 9/2006 | Littlejohn | |
| 2006/0211524 | A1 | | 9/2006 | Balingit | |
| 2006/0243929 | A1 | | 11/2006 | McDaniel | |
| 2008/0248901 | A1 | | 10/2008 | Mosier et al. | |
| 2008/0293521 | A1 | | 11/2008 | Bishop | |
| 2009/0286631 | A1 | | 11/2009 | Hammons et al. | |

* cited by examiner

PITCHING CAGE

CROSS REFERENCE TO RELATED APPLICATIONS

This application claims the benefit of U.S. Provisional Patent Application Ser. No. 61/379,006, filed Sep. 1, 2010, the disclosure of which is hereby incorporated by reference in its entirety.

BACKGROUND

The present invention relates to a training device and in particular, to a pitching cage for training a pitcher to throw a ball to a targeted location.

In sports such as baseball and softball, a pitcher throws a ball towards a designated area that includes a home plate. A batter standing in the area of the home plate attempts to hit the ball with a bat. Pitches are judged to be "balls" or "strikes" in reference to a strike zone that is defined by a two-dimensional imaginary area positioned relative to the home plate. In this regard, the strike zone includes both horizontal and vertical dimensions. Basically, a pitch is judged to be a ball, if the ball is thrown outside of the strike zone. Correspondingly, a pitch is judged to be a strike, if the ball travels past home plate by passing through the strike zone.

The horizontal dimension of the strike zone is generally the width of home plate. Pitches thrown to either side of home plate are out of the strike zone and are thus considered balls. The vertical dimension of the strike zone can vary, and is typically judged to be a dimension spanning from above the knees to below the shoulders of the batter. As such, a ball that travels over or under the vertical span of the strike zone is also considered a ball. Accordingly, a pitch is considered a strike only if the ball travels over home plate and is above the knees to below the shoulders of the batter standing at the plate.

BRIEF SUMMARY

According to aspects of the present invention, a training cage for throwing practice comprises a frame having a height, width and depth. The training cage also comprises a strike zone indicator and a pitch locator. The strike zone indicator defines the boundaries of a strike zone. Correspondingly, the pitch locator is configured such that when the pitch locator is in cooperation with the strike zone indicator, the area of the strike zone is defined by at least one strike area pass through and at least one strike area barricade. Each strike area pass through defines an area that allows a ball, such as a baseball, thrown within the strike zone to pass through the strike zone indicator. On the other hand, each strike area barricade defines an area that obstructs the ball thrown within the strike zone from passing through the strike zone indicator.

A first support suspends the strike zone indicator, and correspondingly, the pitch locator, to the frame so as to position the strike zone indicator in a first designated position. The first support is preferably adjustable so that the strike zone indicator can be relocated within the frame. Moreover, the pitching cage comprises a target having a target surface and a second support. The second support suspends the target to the frame in a second designated position located towards the back of the frame relative to the strike zone indicator. For instance, the target may be positioned behind the strike zone indicator. In this manner, the strike zone locator, the pitch locator and the target cooperate to provide a training cage in which a pitcher can practice targeted throws.

DETAILED DESCRIPTION

According to various aspects of the present invention, a pitching cage is provided, which allows a pitcher to practice in such a way as to develop skill in delivering targeted pitches to desired parts of a strike zone.

Figure 1:
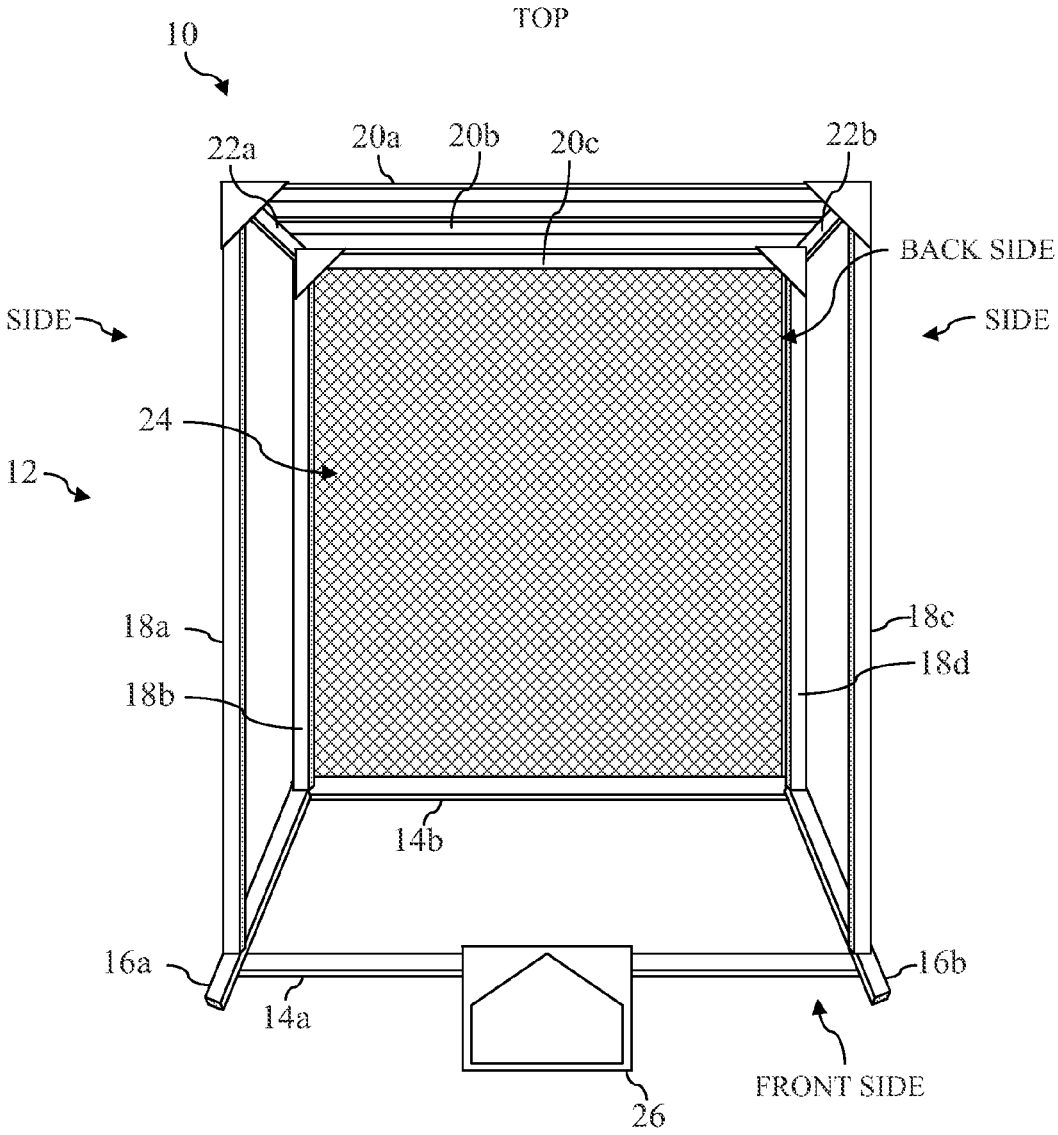
FIG. 1 is an illustration of an exemplary pitching cage, according to aspects of the present invention.

Referring now to drawings and in particular to FIG. 1, a pitching cage 10 is illustrated, which is utilized to assist pitchers in developing this skill necessary to deliver accurate pitches. The pitching cage 10 is utilized to train pitchers for baseball, softball, etc. The pitching cage 10 comprises a frame 12 having a height, width and depth. The frame 12 defines the structure of the pitching cage 10, and thus the dimensions may vary depending upon the particular application. For instance, a pitching cage 10 for relatively younger pitchers, e.g., little league players, may be dimensioned smaller than a version intended for college, minor league or professional pitchers. Although illustrated for ease of discussion as generally rectangular frame members, in practice, the frame 12 may be constructed from members such as hollow tubes having virtually any desired cross-sectional shape. For instance, the frame 12 may be constructed of cylindrical tube members that can facilitate relatively quick assembly and disassembly. This allows the pitching cage 10 to be packed up and easily relocated.

For purposes of illustration, the frame 12 includes a frame base comprised of lateral supports 14*a*, 14*b* (referred to generally by the reference numeral 14) and longitudinal supports 16*a*, 16*b* (referred to generally by the reference numeral 16). As illustrated, there are two lateral supports 14*a*, 14*b* and two longitudinal supports 16*a*, 16*b* that rest upon the ground. However, in practice, any number of supports may be utilized, as the particular implementation may require. The lateral supports 14*a*, 14*b* thus define the width of the pitching cage 10 and may span, for example, 6 to 8 feet (1.8-2.4 meters). The longitudinal supports 16*a*, 16*b* define the depth of the pitching cage 10 and may span for example 3 to 4 feet (0.91-1.2 meters).

Extending from the frame base along each longitudinal support 16 are vertical supports 18*a*-18*d* (referred to generally by the reference numeral 18). As illustrated, there are two vertical supports 18*a*-18*b* extending from the longitudinal support 16*a*, and two vertical supports 18*c*, 18*d* extending from the longitudinal support 16*b*. The vertical supports define the height of the pitching cage 10 and can be any desired height, e.g., 5-7 feet (1.5-2.1 meters). Further, the frame 12 includes a frame top comprised of lateral supports 20*a*, 20*b*, 20*c* (referred to generally by the reference numeral 20) and longitudinal supports 22*a*, 22*b* (generally referred to as 22). In the illustrative implementation, the longitudinal supports 22*a*, 22*b* extend between the outer vertical supports 18*a*-18*d* and lateral supports 20*a*, 20*b*, 20*c*.

In practice, other frame configurations may alternatively be implemented. For instance, the frame 12 may, in practice, use more or less frame members than that illustrated in FIG. 1. The frame 12 may also and/or alternatively include other features, such as diagonal bracing and other support structures as required by a particular application. Still further, each support may comprise one or more individual sections that can be assembled and disassembled to form the frame 12, e.g., to facilitate packing up and moving the frame 12.

The pitching cage 10 also includes a net 24, which is attached to a back side of the frame 12. The net 24 may also wrap around to cover at least a portion of either side of the frame 12, the top of the frame 12, or a combination thereof. In an exemplary configuration, the frame 12 is generally rectangular in cross section, and at least one net 24 is positioned about the back side frame 12 for catching balls thrown into the pitching cage 10.

The pitching cage may also include a simulated home plate 26. As illustrated, the home plate 26 is connected to the lateral support 14*a* of the frame base towards the front side of the pitching cage 10.

Figure 2:
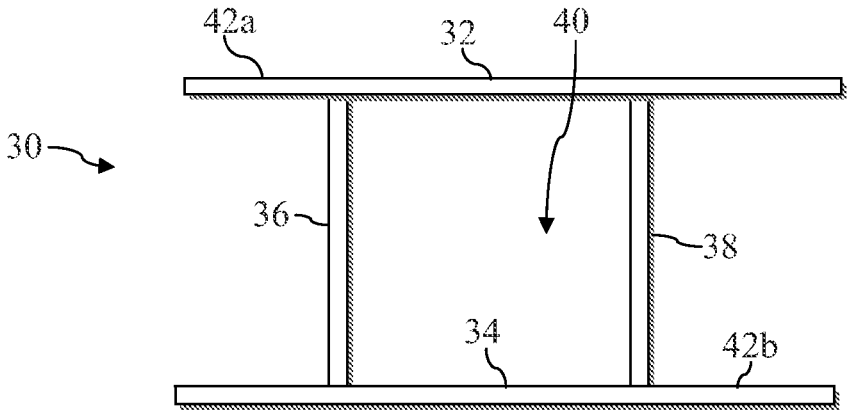
FIG. 2 is an illustration of an exemplary strike zone indicator, according to aspects of the present invention.

Referring to FIG. 2, the pitching cage 10 also comprises a strike zone indicator 30. The strike zone indicator 30 defines the boundaries of a strike zone. The strike zone indicator 30 comprises a plurality of strike zone boundary sections that are configured to designate the dimensions of a desired strike zone. As illustrated, strike zone indicator members 32, 34, 36 and 38 are arranged in a generally rectangular box to bound and thus define a strike zone 40. However, the strike zone indicator 30 may be implemented with alternative configurations or structures to define different strike zones.

The strike zone indicator members 32, 34, 36 and 38 can be constructed from any suitable materials, including bungee or other cords, whether stretchable or not. The strike zone indicator members 32, 34, 36 and 38 may also be constructed of material including by way of non-limiting examples, wood, aluminum, rubber, plastic or other suitable material, e.g., which is intended to withstand impact from balls thrown by a user of the pitching cage 10. In this regard, the strike zone indicator 30 may be comprised of assembled components, or the strike zone indicator 30 may utilize integral sections to define the strike zone boundary.

Still further, according to aspects of the present invention, a strike zone indicator is provided that defines the boundaries of a strike zone, where the strike zone indicator is adjustable in at least one dimension to vary the size of the strike zone. For instance, two or more of the strike zone indicator members 32, 34, 36 and 38 may clip together. This allows rapid adjustment of the strike zone by simply sliding the clips and or by repositioning the strike zone indicator members 32, 34, 36 and 38. Further, the strike zone indicator 30 may be adjustable to define a user selectable size for the strike zone area, such as by replacing the strike zone indicator members 36, 38 with members of a different length, by repositioning the strike zone indicator members 36, 38 relative to the strike zone indicator members 32, 34, or combinations thereof. Thus, according to various aspects of the present invention, one or more strike zone indicator members 32, 34, 36 and 38 may be adjustable to facilitate altering the configuration of the strike zone area.

When the strike zone indicator 30 is coupled to the pitching cage 10, a pitcher is thus provided with a cage to pitch into for practice, that defines a strike zone so that the pitcher has a target to practice against, as will be described in greater detail herein.

The strike zone indicator 30 also includes a first support, reined to generally by the reference numeral 42, for suspending the strike zone indicator 30 within the pitching cage 30 as will be described in greater detail herein. As illustrated, the first support 42 comprises members 42*a*, 42*b* that extend to either side of the strike zone 40. The members of the first support 42 may be integral with the strike zone 30, e.g., a first support member 42*a* may be integral with the strike zone indicator member 32 and a second support member 42*b* may be integral with the strike zone indicator member 34. Alternatively, the members 42*a*, 42*b* of the first support 42 may be separate members that attach to the strike zone indicator 30. For instance, the first support 42 may comprise a rigid structure such as rubber, wire, metal, etc. The first support 42 may alternatively comprise a cord, bungee or other suitable material.

According to further aspects of the present invention, in exemplary implementations, the first support 42 suspends the strike zone indicator 30 to frame members having features that allow the strike zone indicator 30 to be repositionable within the pitching cage 10. For instance, the first support 42 can suspend the strike zone indicator 30 to the frame 12 by attaching to the front-side vertical members 18*a*, 18*c* using any suitable means, e.g., eyelets, hooks, hook and loop fastener, etc. By way of example, in an illustrative example, the vertical members 18*a*, 18*c* include spaced/indexed coupling positions. The coupling positions allows the first support 42 to couple to the frame 12 in a plurality of different positions to simulate different strike zone positions relative to the pitching cage 10. In practice, other methods may be implemented to suspend the strike zone indicator 30 in the designated position within the pitching cage 10.

Figure 3:
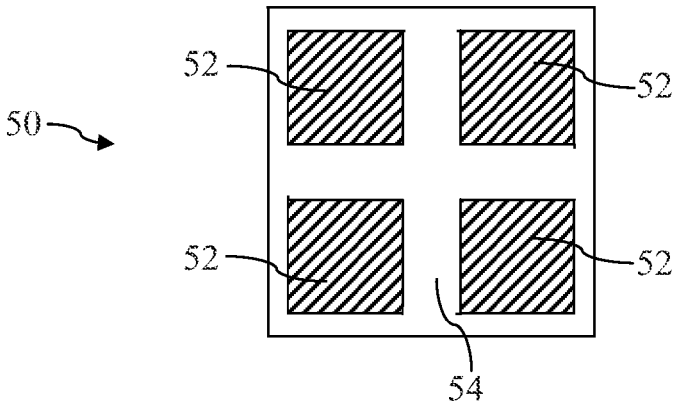
FIG. 3 is an illustration of an exemplary pitch locator, according to aspects of the present invention.

Good pitching practice not only entails throwing the ball into the strike zone, but learning to throw the ball to particular locations within the strike zone. Referring to FIG. 3, according to various aspects of the present invention, a pitch locator 50 is provided. The pitch locator 50 is used in cooperation with the strike zone indicator 30 to narrow the availability of the overall strike zone 40 to one or more specified region/areas within the overall area of the strike zone. In this regard, the pitch locator 50 comprises one or more strike area pass troughs 52. A strike area pass through 52 is an area defined by an aperture in the pitch locator 50 that is sufficiently wide and tall enough to allow a ball thrown by the pitcher to pass through. For instance, in little league baseball, a typical baseball may have a width of approximately 2¾ inches (in.), approximately 6.99 centimeters (cm). As such, in this application, each strike area pass through 52 may be equal to or greater than 2¾ in. (6.99 cm) in length and height.

The pitch locator 50 also comprises one or more strike area barricades 54. A strike area barricade 54 presents an obstruction that is dimensioned and configured so as to stop, catch, or otherwise prevent a ball from passing the strike zone indicator 30. In this regard, each strike area barricade 54 may also be dimensioned to a size equal to or greater than the width of a ball thrown at the pitching cage. For instance, each strike area barricade 54 may be equal to or wider than 2¾ in. (7.0 cm) in width for an application suitable for little league baseball. In the illustrative example, the strike area barricade 54 is a generally cross-shaped member. However, in practice, the strike area barricade(s) 54 may take on other configurations, several other examples of which are described in greater detail herein.

Each section of the strike area barricade 54 is used as an "avoid area." Each avoid area is sized and configured to reduce the available area of the overall strike zone through which ball can be thrown. The strike area barricade 54 thus provides a first feedback that a ball thrown into the pitching cage was within the strike zone, but was not in a pass through portion of the overall strike zone. For instance, the strike zone can be broken down into one or more designated/targeted strike area(s), by obstructing the ball from passing through the strike zone indicator 30 in area(s) of the strike zone outside of the targeted strike area(s) using one or more strike area barricades 54.

According to various aspects of the present invention, a strike zone width is approximated as the width of the home plate plus the width of the ball on either side of home plate 26 allowing a small overlap. As an illustrative example, assume that the dimensions of the strike zone are approximately 24 in. (61.0 cm) wide by approximately 30 in. (76.2 cm) in height. This exemplary width is derived by noting that the home plate 26 may be approximately 19 in. (48.3 cm) wide. Also, as noted above, a baseball is approximately 2¾ in. (7.0 cm) wide. A pitch is considered a strike if the ball crosses the home plate. As such, allowing approximately ¼ in. (0.6 cm) of overlap of the ball to either side of the plate to ensure visual recognition that the ball crossed the home plate, the total width of the strike zone is about 19 in. (48.3 cm)+5 in. (1.2 cm), thus 24 in. (61.0 cm). The 30 in. (76.2 cm) strike zone height represents a dimension spanning from above the knees to below the shoulders of a "representative" batter. In practice, the dimensions of the strike zone can vary.

The cross shape of the strike area barricade 54 in the illustrated example, divides the inside area of the strike zone indicator 30 into four strike areas (i.e., strike zone pass throughs 52) with one strike area in each corner of the strike zone, such that the cross shape of the strike area barricade 54 serves as a strike area obstruction having a width that is sufficient to prevent a ball, e.g., a baseball, from passing through the strike zone indicator 30. For instance, the cross-shape may be dimensioned so that each strike zone pass through 52 is approximately 8 in. (20.32 cm) wide by approximately 10 in. (25.4 cm) wide.

Figure 4:
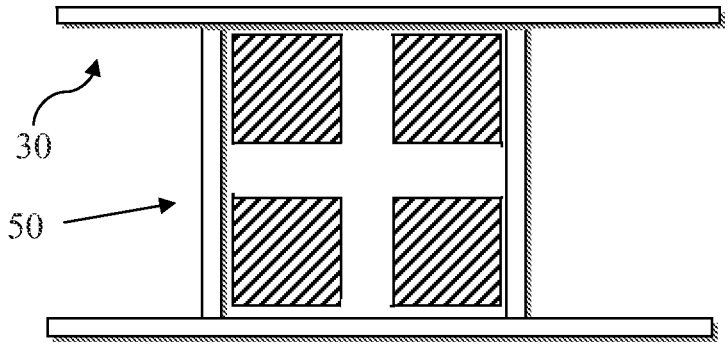
FIG. 4 is an illustration of a strike zone indicator coupled to a pitch locator according to aspects of the present invention.

Referring to FIG. 4, in use, the strike zone indicator 30 is illustrated in cooperation with the pitch locator 50. For instance, the pitch locator 50 may be integral with the strike zone indicator 30. Alternatively, the pitch locator 50 may be attachable/detachable relative to the strike zone indicator 30, e.g., using hook and loop fastener, buckles, clips, snaps or other suitable connectors. The pitch locator 50 may also overlay, register with or otherwise associate with the strike zone indicator 30.

When the pitch locator 50 is in cooperation with the strike zone indicator 30, the strike zone 40 is defined by at least one strike area pass through 52 that defines an area that allows a ball thrown within the strike zone 40 to pass through the strike zone indicator 30. On the other hand, the strike zone 40 is also defined by at least one strike area barricade 54 that defines an area that obstructs the ball thrown within the strike zone 40 from passing through the strike zone indicator 30.

The pitch locator 50 may be comprised of any suitable material, such as rubber or other suitable material that is intended to withstand impact from balls thrown by a user of the pitching cage 10. Moreover, the pitch locator 50 may comprise several discrete pieces that can be arranged or otherwise attached together to define the strike area pass through(s) 52 and strike area barricade(s) 54.

Figure 5:
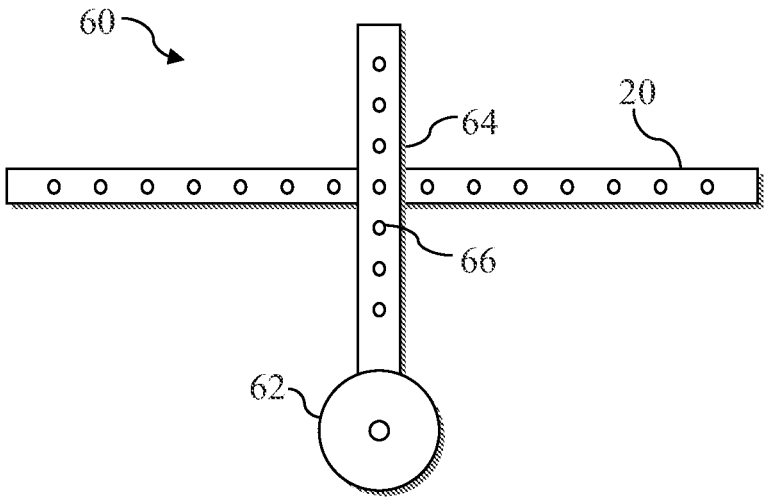
FIG. 5 is an illustration of a target according to aspects of the present invention.

Referring to FIG. 5, a target 60 is illustrated according to various aspects of the present invention. The target 60 comprises a target surface 62, which may be sized and/or dimensioned to simulate the approximate size of a catcher's mitt. The target surface 62 is coupled to a second support 64. For instance, the target surface 62, second support 64, or both may comprise rubber or other suitable material that is intended to withstand impact from balls thrown by a user of the pitching cage 10. In an illustrative example, the second support 64 defines a strap having a plurality of holes 66 in the strap to facilitate repositioning the target 60 within the pitching cage 10.

As illustrated, a lateral support 20 of frame 12, (e.g., the middle lateral support 20*b* of FIG. 1) comprises a plurality of apertures that index across at least a portion of the width of the pitching cage 10. The second support 64 of the target 60 also includes a plurality of apertures there along. Notably, the apertures of the lateral support 20 of frame 12 extend horizontally and the apertures of the second support 64 extend vertically. As such, the target 60 can be repositioned through any number of discrete positions by selecting a hole in the second support 64 of the target 60 and by selecting a corresponding hole in the lateral support 20 of frame 12. A fastener such as a bolt or other device can be used to secure the target 60 by aligning the selected hole of the second support 64 with the selected hole of the lateral support 20 of frame 12. This allows the target surface 62, for example, simulating a catcher's mitt, to be relocated within a two-dimensional plane that extends vertically and traverses laterally across the pitching cage 10.

Further, the second support 64 (and thus the target 60) may be positioned between the net 24 and the strike zone indicator 30. In an exemplary embodiment, the target 60 is positioned substantially equidistant between the net 24 and the strike zone indicator 30. As such, there is a horizontal distance spacing the target 60 from the strike zone indicator 30, and hence, the pitch locator 50.

According to aspects of the present invention, a pitching cage 10 is provided, which is utilized to enable pitchers to develop skill in delivering the ball to targeted locations and to also be aware of where the pitch passes through the strike zone over the home plate.

Figure 6:
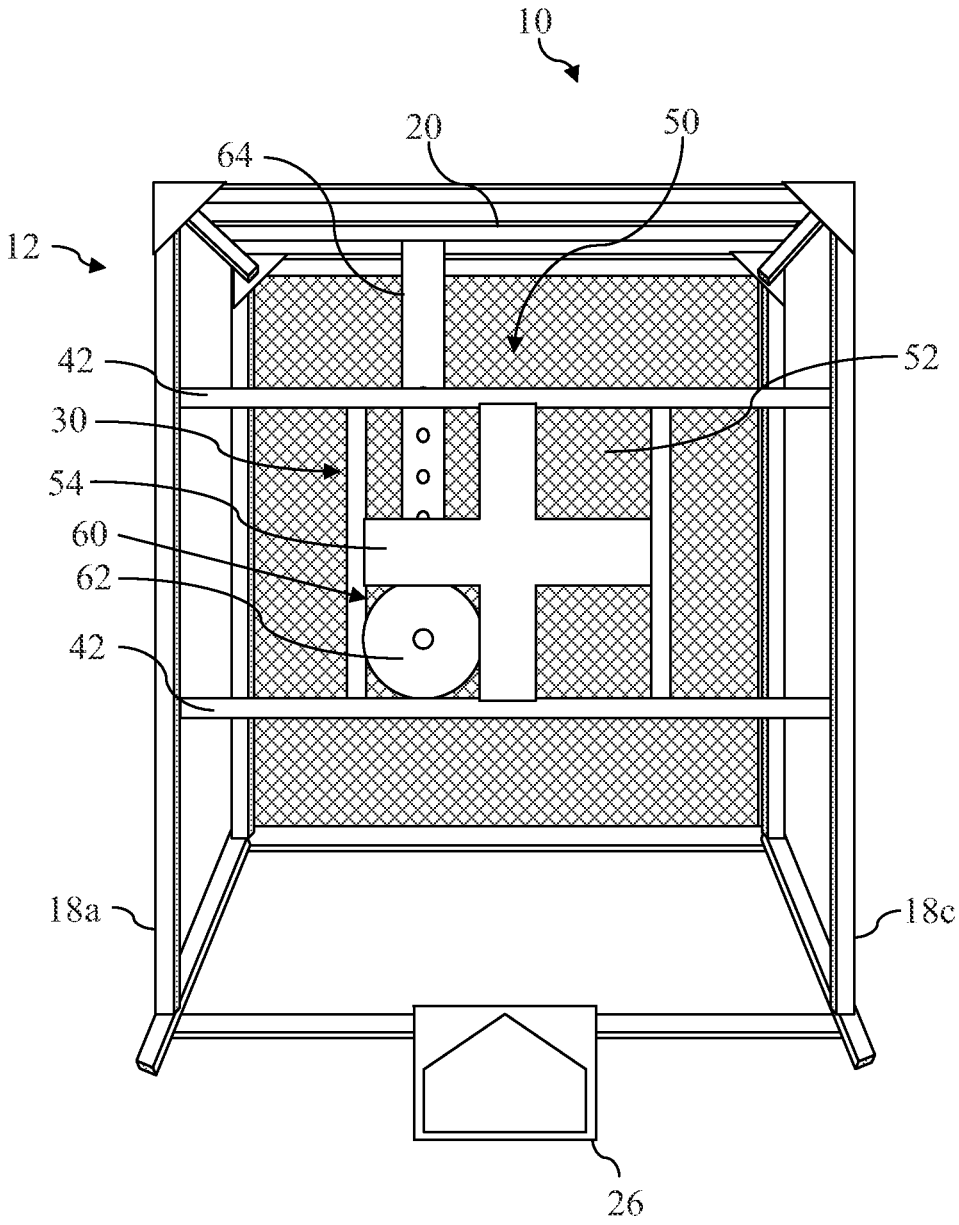
FIG. 6 is an illustration of a pitching cage including a strike zone indicator, a pitch locator, and a target, according to aspects of the present invention.

Referring to FIG. 6, the pitching cage 10 is illustrated in an exemplary configuration, including the frame 12, the strike zone indicator 30, the pitch locator 50 and the target 60. The first support 42 suspends the strike zone indicator 30, and correspondingly, the pitch locator 50, to the frame 12 so as to position the strike zone indicator 30 in a first designated position. For instance, as illustrated, the first support 42 suspends the strike zone indicator 30 to the frame 12 by attaching to the front-side vertical members 18*a*, 18*c* using any suitable means, e.g., eyelets, hooks, hook and loop fastener, etc. By way of example, in an illustrative example, the vertical members 18*a*, 18*c* include spaced/indexed coupling positions. The coupling positions may comprise for example, an eyelet, a screw hook, a slot or other feature that allows the first support 42 to couple to the frame 12. In practice, other methods may be implemented to suspend the strike zone indicator 30 in the designated position within the pitching cage 10.

Moreover, the first support 42 can suspend the strike zone indicator 30 to vertical components 18*a*, 18*c* of the frame 12 so that the strike zone indicator is repositionable within the pitching cage 10. In this regard, the location of the strike zone indicator 30 may be repositioned in the lateral (side-to-side) dimension, vertical dimension, or both to establish a desired strike zone position. The size of the strike zone can be altered by adjusting the dimensions of the strike zone indicator 30 as described more fully herein. For instance, at least one boundary of the strike zone indicator 30 may be adjustable. Still further, the strike zone can be arranged with respect to the simulated home plate 26 so that the pitching cage 10 more accurately simulates a pitching experience for the pitcher throwing balls into the pitching cage 10.

Still further, the target 60 may be attached to the pitching cage 10. The second support 64 suspends the target 60 to the frame 12 in a second designated position located towards the back of the frame 12, in a horizontally spaced position relative to the strike zone indicator 30. The target 60 is typically positioned behind the pitch locator 30, e.g., by hanging the target 60 from the middle lateral support 20*b* of the top frame. In this exemplary implementation, the second support 64 suspends the target 60 to the frame 12 in a second designated position, which may be located behind the strike zone indicator 30. In this regard, the target 60 can be positioned, for example, within the strike zone, and more particularly, in register with, but horizontally spaced from, a select strike area pass through 52. In this manner, the strike zone locator 30, the pitch locator 50 and the target 60 cooperate to provide a training cage 10 in which a pitcher can practice targeted throws.

In the illustrative example, the first support 42 couples to at least one vertical frame member 18 of the frame 12 and the second support 64 couples to an upper horizontal frame member 20 so that the target surface 62 hangs from the second support 64. However, other configurations may alternatively be implemented.

Thus, according to various aspects of the present invention, a pitcher practicing with the pitching cage 10 is provided with a plurality of feedbacks when throwing into the pitching cage. The pitcher receives feedback by observing whether the ball crosses the home plate 26. The pitcher receives a second feedback if the ball is caught by the net without passing through the strike zone.

A strike area barricade 54 positioned within the interior of the pitch locator 50 serves as an obstruction to prevent the ball from passing through a central portion of the interior of the strike zone indicator 30. As such, the pitcher receives yet another feedback that the ball entered the strike zone but hit a strike area barricade 54. For instance, the ball may strike a rubber surface of a strike area barricade 54 and thus fall to the ground about the area of the strike zone indicator 30. Alternatively, the strike area barricade 54 may have a catch or net to trap the ball without letting the ball pass through and beyond the pitch locator 50 and or strike zone indicator 30.

Still further, another feedback is provided where the ball passes through the strike zone and a strike area pass through 52. Still further, the pitcher is provided with yet another feedback where a pitch passes through both the strike zone and a specific strike area pass through 52 and strikes the target surface 62 of the target 60 positioned behind the pitch locator 50. Moreover, another feedback is provided to the pitcher when the ball passes through both the strike zone and strike area, but misses the target surface 62 and hits the net 24.

As illustrated, the pitching cage 10 can be used by a pitcher to practice pitching to the upper and lower corners of the strike zone. More particularly, when the pitch locator 50 is utilized in combination with the target 60, the pitcher can practice pitching low and away to a right-handed batter or low and inside for a left-handed batter, in the exemplary configuration illustrated.

Alternatively, the target 60 can be positioned outside the strike zone, e.g., to practice pitch outs or other techniques where the pitcher intends to throw a pitch intended to be judged a ball by an umpire. In this regard, the target surface 62 can be repositioned to any desired location within the frame 12 of the pitching cage 10 independent of the home plate 26 and the strike zone locator 30.

Figure 7:
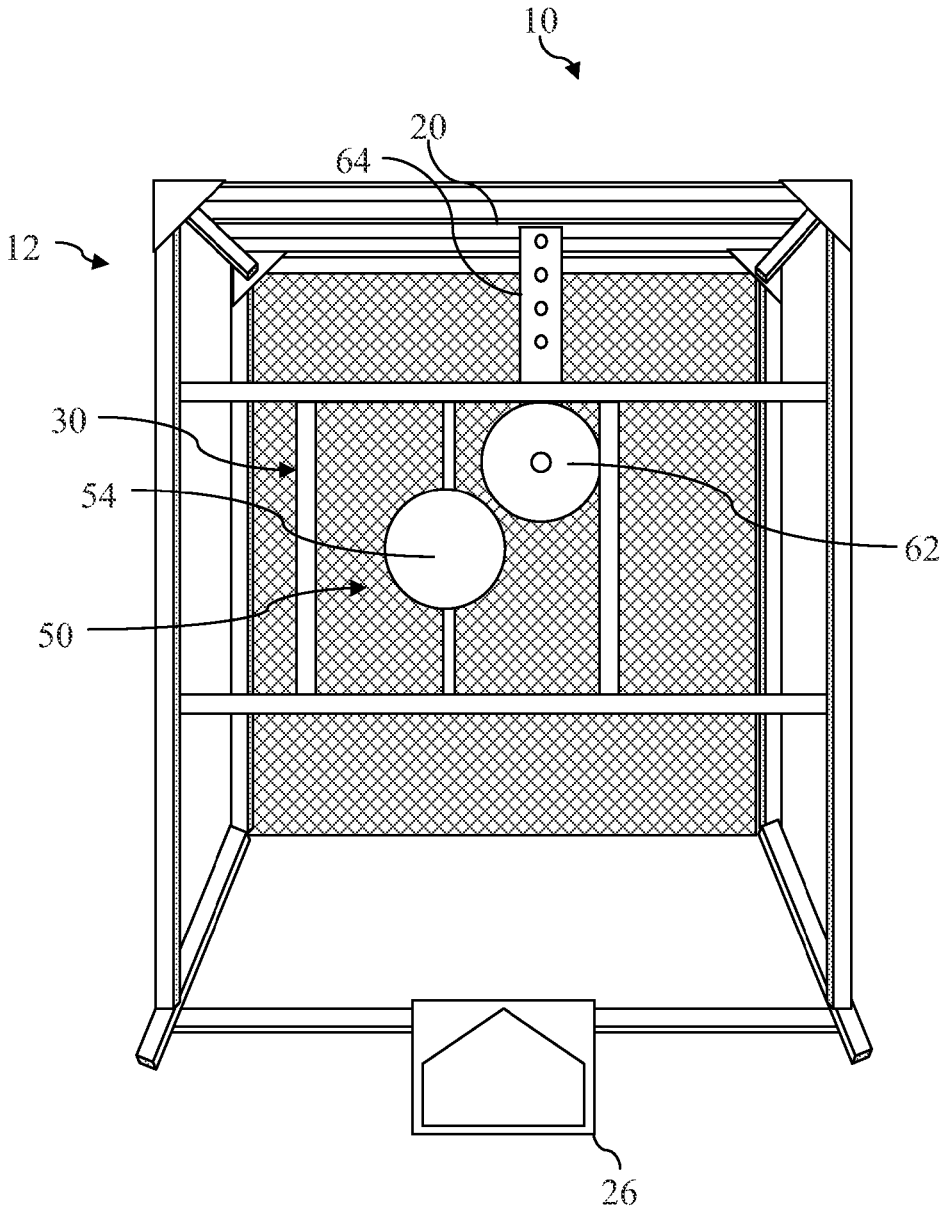
FIG. 7 is an illustration of a pitching cage including a strike zone indicator, a pitch locator, and a target, according to further aspects of the present invention.

A pitcher typically wants to avoid throwing the pitch right down the center of the strike zone because this is one of the easiest pitches for a batter to hit. Referring to FIG. 7, the pitching cage 10 is illustrated with a second illustrative example of a pitch locator 50. In this illustrative example, the pitching cage 10 is substantially similar to that set out above. However, the pitch locator 50 comprises a single strike area barricade 54 located generally in the center of the area defining the strike zone (area bound by the strike zone indicator 30). In this illustrative example, the barricade has a shape that is not a polygon. For instance, as illustrated, the strike area barricade 54 is generally circular. However, the shape of the strike area barricade 54 can alternatively take other shapes, including polygons, such as a square, rectangle, etc. Moreover, the material that suspends the strike area barricade 54 can be of any suitable thickness and/or rigidity necessary to secure the strike area barricade 54 in position relative to the strike zone. Also, the supports may assist in preventing twisting or other otherwise resisting forces applied to the strike zone barricade 54 as a result of getting hit by pitches.

In this regard, the strike zone pass through 52 comprises the area between the strike area barricade 54 and the perimeter of the strike zone defined by the strike zone indicator 30. Also, for clarity of discussion, the target surface 62 is relocated to the upper right hand corner of the strike zone. This allows a pitcher to practice pitching to a batter without giving up a pitch down the center of the strike zone. More particularly, by using the target surface 62, the pitcher can practice pitching high and inside for a right-handed batter or high and outside for a left-handed batter in the exemplary configuration illustrated.

In this regard, depending upon the implementation, the second support 64 couples to the frame 12 such that the target 60 is selectively repositionable in at least one of the lateral, height and depth dimensions within the pitching cage 10.

As an illustrative example, assume that the strike zone area is approximately 24 in. (61.0 cm) by 30 in. (76.2 cm). The shape of the strike area barricade 54 may be dimensioned to a size that is approximately 8 in. (20.3 cm) wide by approximately 10 in. (25.4 cm) wide. The remainder of area defines a strike zone pass through 52.

Figure 8:
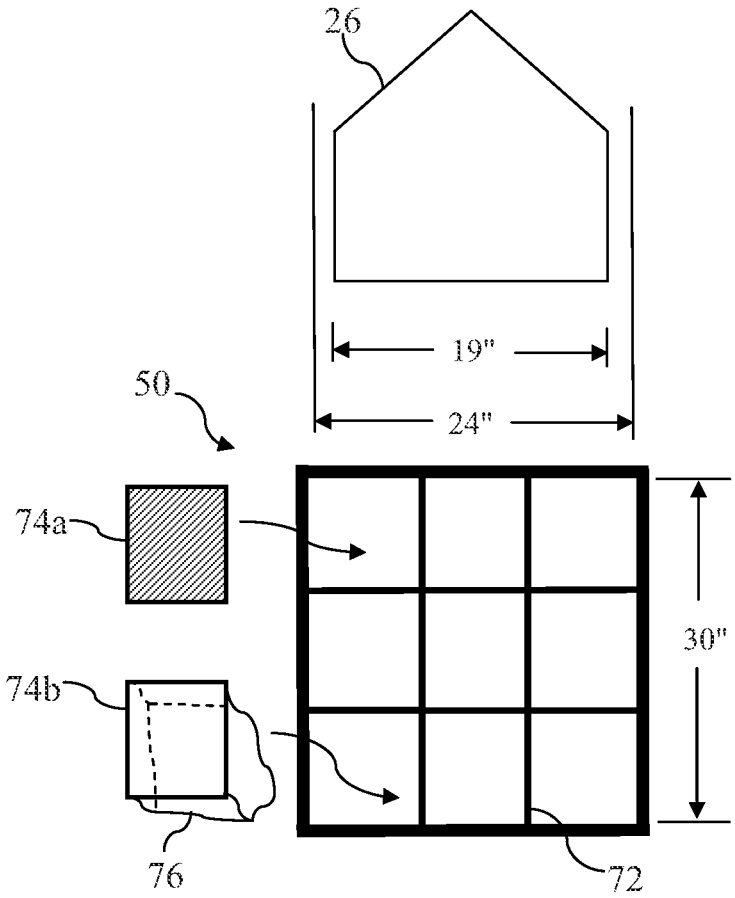
FIG. 8 is a schematic illustration of a home plate and a strike zone divided up into nine regions, according to aspects of the present invention.

Referring to FIG. 8, a schematic diagram illustrates an exemplary mapping of a strike zone. In this figure, the pitch locator 50 is "folded down" into a plane of the home plate 26 to illustrate relative exemplary dimensions for a strike zone and its alignment with home plate 26. In actual use, the pitch locator 50 is coupled to the strike zone locator 30, and the strike zone locator 30 is attached to the vertical frame of the pitching cage 10 so as to suspend the strike zone area facing the pitcher as illustrated FIGS. 6 and 7.

In the illustrative example, the home plate 26 is approximately 19 in. (48.3 cm) wide. Allowing a tolerance for the width of a baseball, e.g., approximately 2¾ in. (7.0 cm) in diameter to cross the corners of home plate, a strike zone is estimated at approximately 24 in. (61.0 cm). As such, the strike zone width, and correspondingly, the width of the strike zone indicator boundary may be approximately 24 in. (61.0 cm). For a typical little league batter, it may be estimated, by way of example that the height of the strike zone is approximately 30 in. (76.2 cm). As such, in this illustrative example, the strike zone is approximately 24 in. (60.96 cm) by 30 in.

(76.2 cm). These dimensions are merely illustrative, and other dimensions may alternatively be utilized.

In the illustrative example, the strike zone indicator 30 is brought into cooperation with a pitch locator 50 such that the strike zone is defined by a structure that includes a harness 72 that divides the strike zone into at least nine regions. Each region may be similarly dimensioned, or the dimensions for each region may be different. For instance, in the illustrative example, the strike zone is broken down into nine regions, and each region may be just under 8 in. (20.3 cm) wide by just under 10 in. (25.4 cm), accounting for the thickness of the harness 72 defining the nine regions. For instance, the inside harness 72 of the pitch locator 50 may be approximately ½ in. (1.3 cm) to approximately 1 in. (2.5 cm) thick.

According to aspects of the present invention, the harness 72 may include a fastener, such as a hook and loop fastener strip applied along one or more surfaces thereof in this regard, one or more pocket cover(s) 74*a* may be utilized to cover a select region or regions thus defining a strike area barricade 54 (or strike barricades 54). Correspondingly, regions that do not include a pocket cover 74*a* define a strike zone pass through 52. Thus, any number of pocket covers 74*a* may be utilized, each pocket cover 74*a* dimensioned to cover a portion of the strike zone.

In this regard, the pitcher, trainer, coach, etc., can reconfigure the strike zone to pinpoint practice with any one or more regions without having to take down the pitch locator 50 or to replace the pitch locator 50 with another variation of patterns for defining the strike zone pass through areas 52 and strike area barricade areas 54. Rather, the only change required is to reposition the pocket cover(s) 74*a* about the harness 72 to cover desired regions. Thus, the available strike zone for practicing can be quickly reconfigured by adding pocket covers 74*a* or removing pocket covers 74*a* to define any desired pattern. In this regard, the pocket covers 74*a* can attach to either the back or the front of the harness. Moreover, any technique may be utilized for temporarily securing a pocket cover over a corresponding region.

Thus, in use, the harness 72 and pocket covers 74*a* may be utilized to create at least one region that defines a strike area pass through 52 that allows a ball thrown within the strike zone to pass through the strike zone indicator 50 and to create at least one region that defines a strike area barricade 54 that obstructs the ball thrown within the strike zone from passing through the strike zone indicator 50. The pocket covers 74*a* thus effectively define a plurality of detachable avoid areas, each avoid area temporarily securable to the structure that divides the strike zone into at least nine regions to define a strike area barricade, such that the at least one region is reconfigurable as either a strike area pass through or a strike area barricade.

According to still further aspects of the present invention, the pocket catch 74*b* may include a pocket 76, e.g., a pouch, net or other structure to catch and hold a ball temporarily, to provide further feedback to the pitcher during use that the pitch entered the strike zone, and entered a corresponding zone. In this regard, any combination of pocket covers 74*a* and pocket catches 74*b* can be used. By way of example, using the arrangement of FIG. 8 with the pitching cage 10, up to at least five feedbacks can be presented immediately to the pitcher. A first feedback is that the pitcher missed the strike zone by the ball traveling into the net outside the strike zone region. A second feedback is that the pitch entered the strike zone, but struck a barricade, e.g., a pocket cover 74*a*. A third feedback is that a pitch entered the strike zone and a region having a pocket catch 74*b* by virtue of a ball being caught in the pouch of a corresponding pocket catch 74*b*. A fourth feedback is given by a ball passing through a strike zone region aligned in register with the target 60. Yet a fourth feedback can be given where a ball passes through the strike zone indicator, e.g., through a region not covered by either a pocket cover 74*a* or pocket catch 74*b*, which misses the target 60 and travels into the net.

The terminology used herein is for the purpose of describing particular embodiments only and is not intended to be limiting of the invention. As used herein, the singular forms "a", "an" and the are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The description of the present invention has been presented for purposes of illustration and description, but is not intended to be exhaustive or limited to the invention in the form disclosed. Many modifications and variations will be apparent to those of ordinary skill in the art without departing from the scope and spirit of the invention.

Having thus described the invention of the present application in detail and by reference to embodiments thereof, it will be apparent that modifications and variations are possible without departing from the scope of the invention defined in the appended claims.

What is claimed is:

1. A pitching cage for throwing practice, comprising:

a frame having a height, a width, a depth, a front end and a back end;

a strike zone indicator that defines a strike zone boundary;

a first support that suspends the strike zone indicator to the frame in a first designated position;

a pitch locator that cooperates with the strike zone indicator to narrow the availability of a strike zone within the strike zone boundary, wherein the strike zone is defined by:

at least one strike area pass through that defines an area that allows a ball thrown towards the front end of the frame within the strike zone to pass through towards the back end of the frame; and at least one strike area barricade that defines an area that obstructs the ball thrown towards the front end of the frame within the strike zone from passing through towards the back end of the frame;

a target having a target surface; and a second support that hangs the target down from a select one of a plurality of lateral supports that span across a top of the frame, the second support having a plurality of holes there along that cooperate with discrete positions along the selected lateral support such that the target can be relocated vertically and laterally across the pitching cage to a position that is set to a select one of within the strike zone and outside the strike zone, wherein the target is further selectively repositionable between the strike zone indicator and the back end of the frame thus allowing adjustment in depth, and wherein the target obstructs the ball thrown into the frame from passing towards the back end of the frame.

2. The pitching cage according to claim 1, wherein:

the frame is generally rectangular in cross section; and a net is positioned about at least a portion of the back end of the frame for catching balls thrown into the pitching cage.

3. The pitching cage according to claim 2, wherein:

the target is positioned between the net and the strike zone indicator.

4. The pitching cage according to claim 3, wherein:

the target is positioned generally equidistant between the net and the strike zone indicator.

5. The pitching cage according to claim 1, wherein:

the strike zone indicator is repositionable within the pitching cage.

6. The pitching cage according to claim 5, wherein:

the strike zone indicator is adjustable in size to change dimensions of the defined strike zone boundary.

7. The pitching cage according to claim 1, wherein:

when the pitch locator is in cooperation with the strike zone indicator, the strike zone is defined by:

a structure that divides the strike zone into at least nine regions;

at least one region defines the at least one strike area pass through that allows a ball thrown within the strike zone to pass through towards the back end of the frame; and at least one region defines the at least one strike area barricade that obstructs the ball thrown within the strike zone from passing through towards the back end of the frame.

8. The pitching cage according to claim 7, further comprising:

a plurality of detachable avoid areas, each avoid area temporarily securable to the structure so as to cover a corresponding one of the at least nine regions to define a strike area barricade.

9. The pitching cage according to claim 8, further comprising a detachable catch having a pouch therein, for catching a ball thrown into the strike zone region of the catch.

10. The pitching cage according to claim 1, wherein:

the pitch locator comprises:

a cross that divides the inside area of the strike zone indicator into four strike areas, one strike area in each corner, such that the cross serves as a strike area barricade having a width that is sufficient to prevent a ball from passing through the strike zone indicator.

11. The pitching cage according to claim 1, wherein:

the at least one strike area barricade is defined by a first strike area barricade positioned within an interior of the pitch locator such that the first strike area barricade serves as an obstruction to prevent the ball from passing through a central portion of the interior of the strike zone indicator, wherein the ball can pass through the strike zone outside the central portion.

12. The pitching cage according to claim 1, wherein:

the at least one strike area barricade is defined by a first strike area barricade positioned within an interior of the pitch locator such that the first strike area barricade has a shape that is not a polygon, and serves as an obstruction to prevent the ball from passing through a portion of an interior of the strike zone indicator.

13. The pitching cage according to claim 1, wherein the target is positioned spaced behind and in a horizontally spaced relation relative to a select strike area pass through of the strike zone indicator, wherein the target obstructs the ball thrown through the select strike area pass through from passing towards the back end of the frame.

14. The pitching cage according to claim 1, further comprising:

a home plate arranged at a base of the frame aligned with the strike zone indicator.

* * * * *